US005405479A

United States Patent [19]

Anderson

[11] Patent Number: 5,405,479

[45] Date of Patent: Apr. 11, 1995

[54] AUTOMATIC VALVE INSERTION METHOD

[75] Inventor: Brent G. Anderson, Mt. Prospect, Ill.

[73] Assignee: CTI Industries Corporation, Barrington, Ill.

[21] Appl. No.: 170,018

[22] Filed: Dec. 20, 1993

[51] Int. Cl.[6] ..... B32B 31/10

[52] U.S. Cl. ..... 156/308.4; 156/251; 156/289; 156/290; 156/300; 156/303; 156/306.6; 156/324; 446/224

[58] Field of Search ..... 156/145, 300, 308.4, 156/308.6, 290, 292, 251, 306.6, 303, 289, 324; 446/224

[56] References Cited

U.S. PATENT DOCUMENTS

| | | | |
|---|---|---|---|
| 2,713,746 | 7/1955 | Haugh | 446/224 |
| 3,230,663 | 1/1966 | Shabram | 446/224 |
| 4,708,167 | 11/1987 | Koyanagi | 137/512.15 |
| 4,917,646 | 4/1990 | Kieves | 446/224 |
| 4,983,138 | 1/1991 | McGrath | 446/224 |
| 5,248,275 | 9/1993 | McGrath et al. | 446/224 |

*Primary Examiner*—Michael W. Ball

*Assistant Examiner*—Francis J. Lorin

*Attorney, Agent, or Firm*—Tilton, Fallon, Lungmus & Chestnut

[57] ABSTRACT

An improved method for inserting valves between the front and back panels of inflatable bodies, such as novelty balloons or air-inflated dunnage bags, is disclosed. The method includes the steps of conveying an upper web through an upper roller assembly and conveying a lower web through a lower roller assembly positioned adjacent to and below, and pivotal relative to, the upper roller assembly. The valve is then inserted between the top and bottom webs as they pass through the roller assemblies and then the roller assemblies are pivotally clamped together to bring the top and bottom webs together and frictionally engage the valve between the webs. The webs are then conveyed, with the valve clamped therebetween, to a downstream die station without any attachment of the valve to either of the webs prior to reaching the die station. At the die station, the perimeter of the inflatable body shape is heat sealed into the webs which simultaneously heat seals the valve to both of the webs.

8 Claims, 2 Drawing Sheets

AUTOMATIC VALVE INSERTION METHOD

BACKGROUND AND SUMMARY

The present invention relates to an apparatus for and a method of inserting valves between front and back panels of inflatable bodies such as novelty balloons or dunnage bags. More particularly, this invention relates to a method and apparatus for inserting a valve between a front and back panel of an inflatable body without requiring that the valve be initially tacked or otherwise permanently attached and pre-positioned to one of the panels prior to conveying the panels through a die station which forms the completed inflatable body with a seal of all layers and the valve.

Currently, there are many types of inflatable bodies that are mass produced and easier methods for producing such inflatable bodies are useful in reducing the costs associated with such mass production. One example is novelty balloons of the metalized mylar or nylon type that typically have a front panel and back panel sealed together about their periphery to form an inflatable body. Such balloons often have novelty messages such as "Happy Birthday", "Happy Anniversary", "I Love You" and the like printed thereon and have become quite popular. Another example are inflatable dunnage bags that are a substitute for discrete packing materials and used for bearing against delicate or fragile articles in closed containers during shipment. Such inflatable dunnage bags are greatly advantageous over prior art methods, such as filling boxes full of styrofoam popcorn which can be harmful to the environment.

With respect to such novelty balloon and dunnage bag products, it is known to use an elongated, self-sealing valve comprised of top and bottom layers of flexible plastic film materials, which layers are sealed along their longitudinal edges to create a valve inlet, a valve outlet, and a passage therethrough. However, merely placing such self-sealing valves between the front and back panels of an inflatable body during the manufacturing, i.e., film conversion, process has proven to be disadvantageous. This is because if the valve is simply laid upon one of the webs of plastic film material that forms the top or bottom panel of the inflatable body, vibrations in the machinery, wind or air currents, gravity, and a variety of other factors can cause the valve to move relative to the web, thereby resulting in the valve being sealed between the body's panels in a misaligned fashion. Such products, when formed with such misaligned or otherwise improper valves, are non-usable and create wastage.

One method known in the art to prevent the above problems is to initially tack seal or otherwise permanently attach the valve to one of the panels or webs during the conversion process at a time prior to sealing the panels together to form the inflatable body. U.S. Pat. No. 4,917,646, issued to Kieves, is illustrative of such an initial tack sealing method. That patent discloses a valve that has a positioning tab which can be tacked with a heat seal, i.e., permanently pre-positioned, during the manufacturing process directly to one of the webs. Although tacking the valve to one of the panels will ensure that the valve is not misaligned or otherwise incorrectly placed in the inflatable body, the method is disadvantageous in that it requires the complicated, and additional, i.e., expensive, step of initially tack sealing the valve to one of the webs immediately after placement on the web to ensure that the valve does not become misaligned. This tack seal must be made before conveying the panels to a die station as such movement might cause the valve to become misaligned and such initial tack sealing and the equipment to perform it are cumbersome and expensive.

An important aspect of this invention therefore lies in providing a method and related apparatus for manufacturing an inflatable body with a self-sealing, flexible valve which does not require that the valve be initially tack sealed to or otherwise permanently pre-attached to one of the panels prior to conveying the film webs to a die station and forming the inflatable body from the panels. Briefly, the method of this invention comprises the steps of forming the self-sealing valve, conveying the upper web of sheet material through an upper roller assembly, and conveying a lower web of sheet material through a lower roller assembly. The next step is inserting the valve between the top and bottom webs at a position at which the webs are respectively passing through the roller assemblies and converging upon one another. Prior to insertion, the valve should be aligned perpendicular to the direction of travel of the webs. Thereafter, the next step is that the upper and lower roller assemblies are clamped together so as to bring the top and bottom webs together and frictionally engage the loosely inserted valve therebetween. The webs and frictionally clamped valve are then conveyed to a die station without any permanent pre-attachment of the valve to either of the webs. As a next step, at the die station the perimeter of an inflatable body shape is heat sealed onto the webs and the valve such that the valve is simultaneously heat sealed to both the webs, i.e., valve is sealed to both webs at the same time. Alternatively, an additional roller die can be provided just after the roller assemblies and before the die station to simultaneously heat seal the loosely inserted valve to both the top and bottom webs before the downstream heat sealing of the peripheral shape of the inflatable body.

In another embodiment of the method of this invention, where automation is desired, the method can additionally involve providing a linear slide having a distal end positioned adjacent to the upper and lower roller assemblies and a proximal end positioned a distance away from the roller assemblies. A guide rail is positioned parallel to the linear slide. A vacuum table is provided on the linear slide so as to be slideable between the distal and proximal ends of the linear slide. A separate valve forming apparatus, well known in the art, can then be located adjacent the linear slide and used to automatically form the valves and then place them on the vacuum table when the latter is positioned at the proximal end of the slide. Pneumatic vacuum ports are provided on the vacuum table to retain the valve inlet end of the valve in position on the table while the associated guide rail supports the outlet end of the valve. A further proximity sensor can be used to detect when a valve has been placed on the vacuum table, and the table can then be advanced to the distal end of the linear slide to insert the valve between the converging top and bottom webs. Thereafter, the steps of clamping the roller assemblies together about the film webs and loosely inserted valve, conveying the clamped webs and valve to a die station, and then heat sealing the peripheral shape of an inflatable body can all then be performed in a continuous, automatic operation.

The apparatus of this invention comprises an upper roller assembly, a lower roller assembly positioned adjacent to and below the upper roller assembly and means for conveying a top web through the upper roller assembly and a bottom web through the lower roller assembly. Valve insertion means are provided for inserting a valve between the top and bottom webs. Preferably, such a valve insertion means takes the form of a linear slide having a distal end positioned adjacent to the roller assemblies and a proximal end positioned a distance away from the roller assemblies, a guide rail positioned parallel to the length of the linear slide, and a vacuum table that is slideably mounted on said linear slide and is moveable between its distal and proximal ends. The vacuum table is further provided with vacuum ports for retaining a valve thereon. A valve may be placed on the vacuum table while it is at the proximal end of the linear slide and the vacuum table is slideable along the linear slide to the distal end at which point the vacuum table inserts the valve between the upper and lower webs. Thereafter, a die station is provided for heat sealing the perimeter of an inflatable body shape on the webs and simultaneously heat sealing the valve to both of the webs.

Preferably, the materials of which the valves and webs are comprised are selected based on their high instance of surface adhesion that occurs between the webs and the valve. Examples of such materials include constructing the webs of thin layers of high density polyethylene, low density polyethylene, linear low density polyethylene, and polypropylene or a combination of these materials, while constructing the valve of thin layers of high density polyethylene, low density polyethylene, linear low density polyethylene, and polypropylene or a combination of these materials. In one embodiment, the method involves the further steps of sensing with a proximity sensor when the valve is positioned between the top and bottom webs and then sending a signal to a pneumatic cylinder connected to the lower roller assembly, which is pivotally mounted to thereby perform the clamping step. In the situation where inflatable dunnage bags are being produced, for example, the valve can be inserted between the webs so that at least a portion of the valve, preferably at least 1 inch or more, extends out from between the periferally sealed film webs making up the bag body.

Other objects, features, and advantages of the present invention will become apparent from the following specification and drawings.

DRAWINGS

DETAILED DESCRIPTION OF PREFERRED EMBODIMENTS

Figure 1:
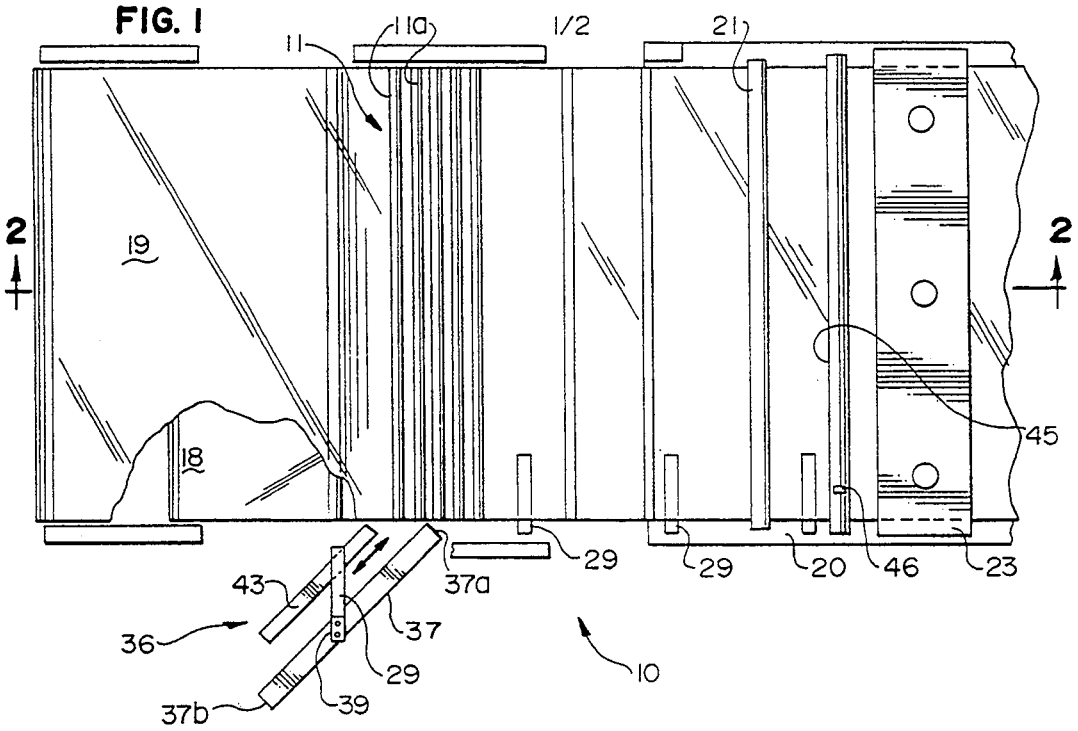
FIG. 1 is a schematic, top plan view of the apparatus used in the method of the present invention.
Figure 2:
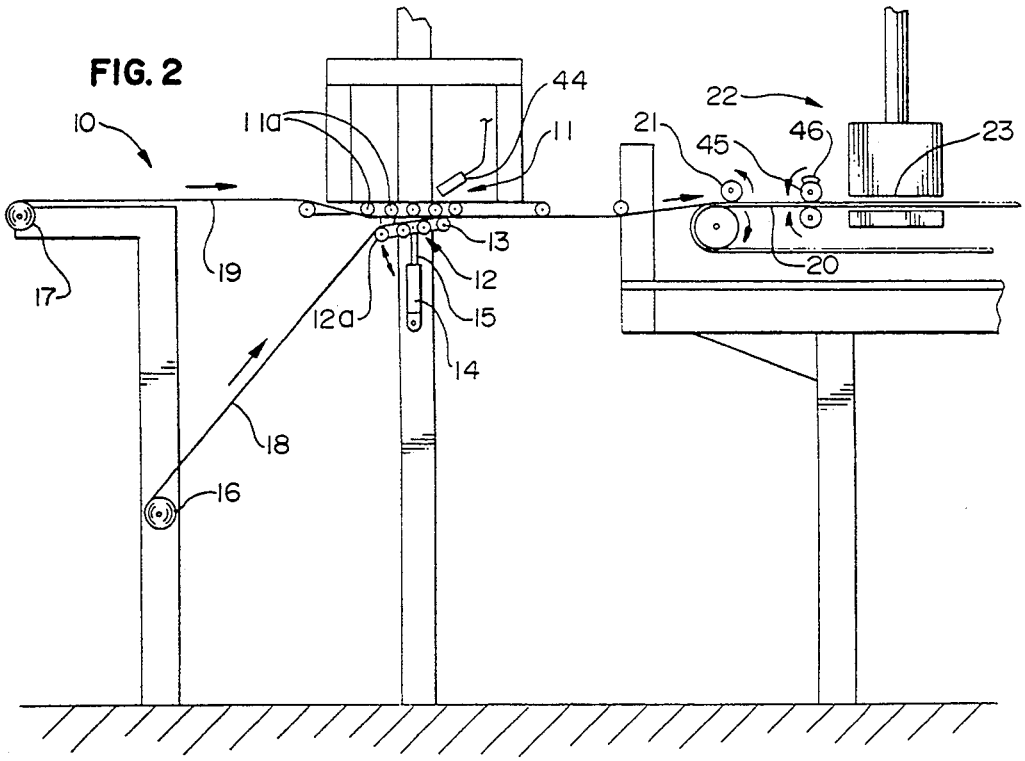
FIG. 2 is a schematic, side view of an apparatus used in the method of the present invention.

In FIGS. 1 and 2, the numeral 10 generally designates a station in an inflatable body converting machine used in the method of the present invention. Converter station 10 comprises an upper roller assembly 11 including a plurality of rollers 11*a* and a lower roller assembly 12 including a plurality of rollers 12*a*. However, roller assembly 12 is positioned adjacent to and below upper roller assembly 11. Further, lower roller assembly 12 is pivotable—relative to the fixed upper roller assembly 11—about a hinge 13, and a pneumatic or hydraulic cylinder 14 and piston 15 are provided for pivoting lower roller assembly 12 about hinge 13. Cylinder 14 and piston 15 thus are operable to pivotally raise or lower the lower roller assembly 12, i.e., into a position spaced apart from upper roller assembly 11 or inserted into a position in which the roller assemblies 11, 12 are tightly engaged to clamp sheets of web material travelling therebetween. Although it is preferable that the lower roller assembly be adjustably positionable, it will be understood that the lower roller assembly could instead be fixed and the upper roller assembly could be adapted to pivotally or otherwise shift positions.

In order to form the respective front and back panels of an inflatable body that is heat sealed about its periphery, a pair of supply spools 16 and 17 are respectively provided with a quantity of lower and upper web materials 18 and 19. Depending upon the particular application, the upper and lower webs may be constructed of the same material; common materials for balloons or dunnage bags include nylon, polyethylene, mylar, polypropylene, polyester, or a composite laminate made of these or other similar thin, flexible, plastic-like materials. In any event, the selected materials should preferably have a high incidence of surface adhesion with the material selected for the self-sealing valve. A drawing means is provided for pulling webs 18 and 19 from spools 16 and 17 and drawing the webs through the upper and roller assemblies 11 and 12. In one embodiment, the drawing means takes the form of a conveyor belt 20 and a draw roller 21 which together pinch the web materials 18 and 19 therebetween. Such a film drawing set up is conventional; it will be understood that other known systems of drawing the webs through the upper and lower roller assemblies 11 and 12 may instead be employed with the present invention.

Figure 5:
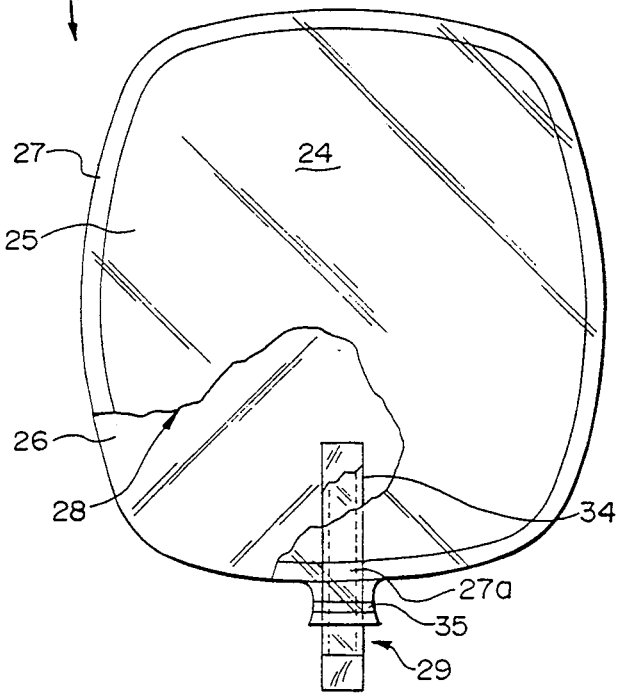
FIG. 5 is a plan view of a completed product of an inflatable body and self-sealing valve.

Once the lower and upper webs 18 and 19 pass through the roller assemblies 11 and 12 and the drawing means, they are drawn along conveyor belt 20 into a die station generally designated at 22. Die station 22 includes an inflatable body peripheral die stamp 23 that is used to heat seal the webs together, separate the sealed body from the webs 18 and 19, and thus form an inflatable body. Examples of such inflatable bodies include novelty balloons and dunnage bags, and stamp 23 can be specifically designed for the particular inflatable product application and inflatable body shape. FIG. 5 illustrates one such inflatable body shown as balloon 24 having a first panel 25 formed from upper web 19 and an opposite panel 26 formed from lower web 18. The webs are sealed together about their periphery 27 by heat seal die stamp 23 to form an inflatable chamber 28. As seen, according to the present invention, a valve 29 is disposed between panels 25 and 26 for inflating chamber 28.

Figure 4:
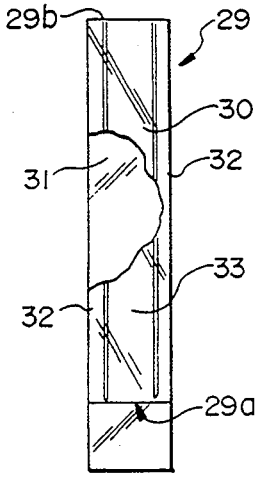
FIG. 4 is a schematic, enlarged view of the valve used in the method of the present invention.

FIG. 4 more clearly illustrates valve 29 which includes a valve inlet 29*a* at one end and a valve outlet 29*b* at the opposite end, a first flexible plastic layer 30, a second plastic layer 31, and a heat seal 32 extending along the longitudinal edges of layers 30 and 31 so as to form a passage 33 extending through the valve from inlet 29*a* to outlet 29*b*. Depending upon the application, the flexible valve 29 can be of the well-known "self-sealing" type. That is, it has a sufficient length 34 to extend into the inflatable chamber 28 such that when the inflatable body is filled, i.e., filled with helium, air, or other inflative gas, the two layers making up the length 34 of valve 29 will compress flat upon themselves, in a well known manner, and seal the valve passageway 33.

Valve 29 is preferably made of a flexible, relatively thin, plastic-like sheet material, such as high density polyethylene, low density polyethylene, linear low density polyethylene, polypropylene or a combination of these materials; preferably the material selected for valve 29 will have a high incidence of surface adhesion with the material of panels 25 or 26, or webs 18 or 19. In the method of this invention, valve 29 is retained between panels 25 and 26 by heat seal portion 27*a* that forms part of the peripheral heat seal 27 which forms balloon body 24. As more fully discussed below, an additional pre-positioning heat seal 35 may be added after the clamp assemblies 11 and 12, and before stamp 23, to simultaneously seal valve 29 to both the first and second panels 25, 26.

Figure 3:
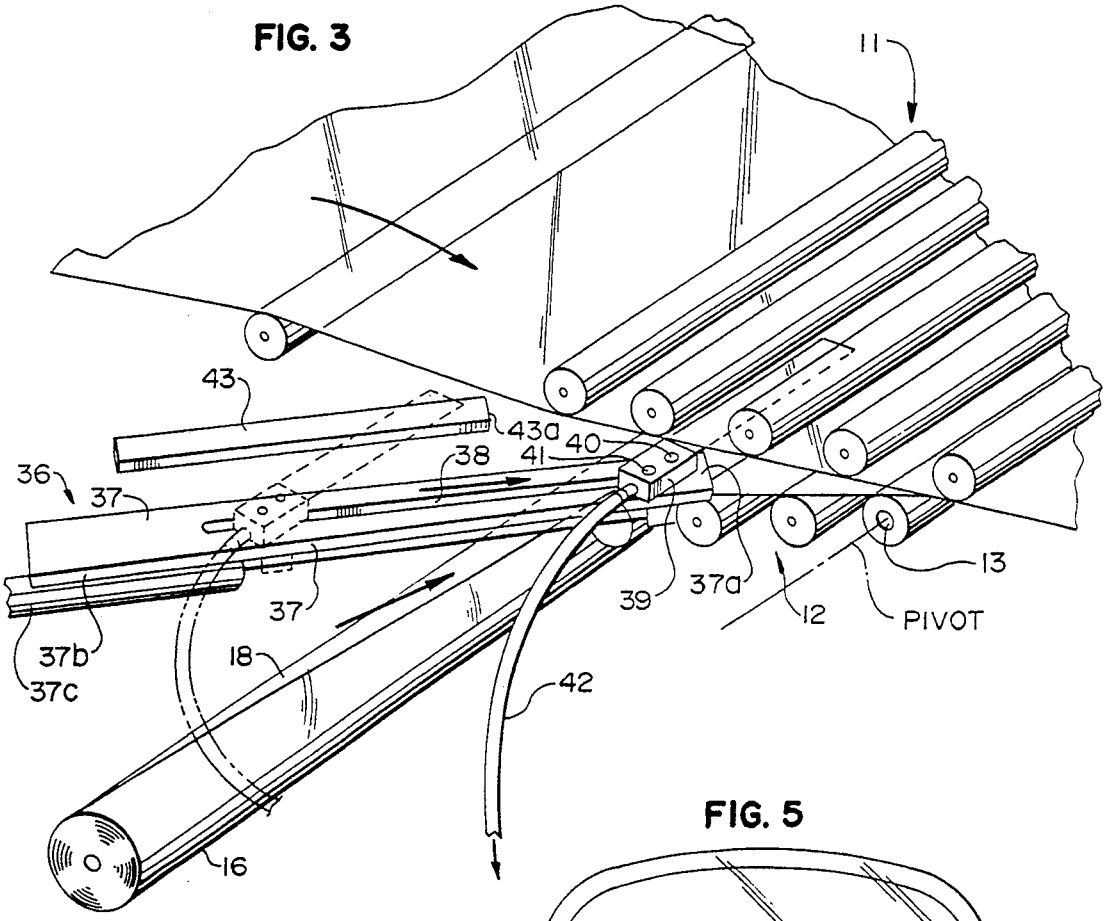
FIG. 3 is a schematic, enlarged side view of the upper and lower roller assemblies.

In the method of this invention, it is conceivable that many types of valve insertion means may be employed, i.e., for inserting valve 29 between the upper and lower webs 18 and 19, including manual insertion. However, the peripheral valve insertion means of the apparatus of this invention, generally designated at 36, and shown most clearly in FIGS. 1 and 3, is believed to be particularly effective for inserting valves between the upper and lower webs. Valve insertion means 36 is automatic in that it does not require manual placement of the self-sealing valves between the webs. Further, it is possible to convey valves from an automatic valve forming machine directly onto the valve insertion means, thereby eliminating manual handling of the valves altogether. Such a valve insertion means 36 preferably takes the form of a linear slide 37 that is positioned at an angle to the direction of travel of webs 18 and 19 (to the right in FIGS. 1–3). Slide 37 includes distal end 37*a* which is positioned at a valve insertion position directly adjacent webs 18 and 19 as they pass through the upper and lower roller assemblies 11 and 12, and also a proximal end 37*b* which is positioned at a distance away from the roller assemblies.

Slide 37 is provided with a guide track 38 in which a vacuum table 39 is slideably mounted. Such a track 38 and vacuum table 39 are well known. A pneumatic device or similar mechanism designated at 37*c* can be used to quickly shift table 39 between distal end 37*a* and proximal end 37*b* of slide 37. Table 39 is provided with a pair of vacuum ports 40 and 41 that are connected to a pneumatic suction line 42 (as best seen in FIG. 3). Such a vacuum device can be used to selectively provide a suction pressure at ports 40 and 41; this acts to retain the inlet end 29*a* of valve 29 on the table 39. Valve 29 is placed onto valve insertion means 36, by manual or automatic placement, with its inlet end 29*a* on table 39 while its outlet end 29*b* is supported on guide rail 43 for sliding movement therealong. Guide rail 43 runs parallel to slide 37 and has its distal end 43*a* above lower web 18 (when lower roller assembly 12 is pivoted to its lowered position) such that when shuttle 39 is transported to the distal end 37*a* of slide 37, the outlet valve end 29*b* will slide off of guide rail 43 and onto lower web 18 for continued support thereby.

Once valve 29 has been completely inserted between the upper and lower webs and roller assemblies, a conventional proximity sensor 44 is used to detect when such placement has occurred, sensor 44 sends a signal to pneumatic cylinder 14 to operate piston 15 and pivotally move lower roller assembly 12 into a closed position. That acts to clamp the upper and lower webs 19 and 18 together and frictionally secures valve 29 between the webs. Thereafter, the drawing means draws the upper and lower webs 19 and 18, with the valve 29 loosely yet frictionally held therebetween, and conveys the clamped web sections and retained valve onto die station 22. Because the webs 18 and 19 are securely clamped about valve 29, no initial tacking or other permanent pre-positioning to one web is required to maintain the valve in place, i.e., at a time prior to the webs reaching the die station.

Once a given clamped section of the webs 19 and 18 having a valve 29 inserted therebetween reaches die station 22, the hot die stamp 23 can be used to heat seal the periphery of the selected inflatable body shape onto the webs and valve. This acts to simultaneously heat seal the valve 29 to both of the webs 19 and 18 at the same time, i.e., at 27*a* (as shown in FIG. 5). Although such a heat seal portion at 27*a*, along with the simultaneous peripheral sealing of the inflatable balloon body shape, is sufficient to secure the self-sealing valve 29 in place without misalignment or other difficulties, it additionally may be desired to provide yet another seal 35. This would be achieved (see FIGS. 1 and 2) by using a rotating preliminary die 45 at a position just after the clamp assemblies 18 and 19 and well before the die station 22. Preferably, the rotating die 45 would have a protruding member 46 that is shaped to simultaneously form a linear heat seal 35 across both of the webs 18 and 19 and valve 29, all at the same time. Use of such a rotating die 45 is advantageous as its period of rotation can be timed to coincide with the timing of the valves as they reach the die station. Alternatively, it could simply form a continuous linear seal of both webs 19 and 18 and any valve 29 when present, all prior to the downstream sealing of the body changes of webs 18 and 19 and again of valve 29. Such a preliminary seal 35 of the valve 29 to both of the webs 18 and 19 may be desirable in situations in which the configuration of the inflatable body is rather complicated, such as a dinosaur shape, and a separate heat seal of the valve to both of the webs is desired or where the machine travel speed for webs 18 and 19 is excessive.

In one embodiment of the method of this invention, valve 29 is first formed by a conventional valve forming machine and the drawing means 21 is set in motion to convey lower and upper webs 18 and 19 through the upper and lower roller assemblies 11 and 12. Successive valve members 29 are then cyclically inserted between the lower and upper webs 18 and 19 at a valve insertion position, i.e., where the webs 18 and 19 are respectively passing through the roller assemblies 11 and 12, and are beginning to converge upon one another. The proximity sensor 44 senses when a valve 29 has been fully placed between the webs 18 and 19 and sends a signal to the pneumatic cylinder 14 which clamps the upper and lower roller assemblies 11 and 12 together to bring the lower and upper film webs 18 and 19 together and thereby loosely but frictionally engages and retains the valve between the webs. Thereafter, the clamped webs and valve to a downstream die station without any permanent attachment of the valve to either of the webs. At the die station 22, body shape and die cut stamp 23 heat seals the perimeter of an inflatable body shape such that the valve is simultaneously heat sealed to both of the webs, and also cuts out the resulting body shape from webs 18 and 19. If desired, ahead of die stamp 23, there can be provided a preliminary die roller 45 that applies a preliminary heat seal 35, i.e., to simultaneously heat seal valve 29 to both of the webs 18 and 19 so as to help valve 29 in connect position and alignment vis-a-vis webs 18 and 19 and the following die station 22.

In another embodiment, successive valves 29 can be automatically inserted between the lower and upper webs 18 and 19 and the same steps of forming the valve and conveying the webs through the roller assemblies 11 and 12 are performed. However, a linear slide 37 is provided having a distal end 37*a* positioned adjacent to the upper and lower roller assemblies and having a proximal end positioned at a distance away from the roller assemblies. The linear slide 37 is positioned at an angle to the web and a guide rail 42 is provided which is parallel to the linear slide. A vacuum table 39 is provided on linear slide 37 and is operable to be moved along the slide table 39 has a plurality of suction ports 40 and 41 for retaining one end of a valve 29 thereon while the other end of the valve is slideably supported on guide rail 42. Thereafter, table 39 is advanced by pneumatic or hydraulic means 37*c* to the distal end 37*a* of the linear slide 37 to thereby insert the outlet end 29*b* of valve 29 between the lower and upper webs 18 and 19. Thereafter, proximity sensor 44 sends a signal to the hydraulic cylinder 14 which clamps the upper and lower roller assemblies 11 and 12 together to frictionally engage the valve 29 between the webs 18 and 19. The respective clamped web sections and retained valve are then conveyed downstream to the die station 22 where the final product can be formed and removed from the remaining web material.

While in the foregoing, embodiments of the invention have been disclosed in considerable detail for purposes of illustration, it will be understood by those skilled in the art that many of these details may be varied without departing from the spirit and scope of the invention.

I claim:

1. An improved valve insertion method for inserting a flexible valve between a front and back panel of an inflatable body, said method comprising the steps of:

providing a flexible preformed unitary valve comprised of first and second flexible plastic layers which define a passage extending therethrough, a valve inlet, and a valve outlet;

conveying an upper web of sheet material through an upper roller assembly;

conveying a lower web of sheet material through a lower roller assembly positioned adjacent to and below said upper roller assembly;

inserting said preformed unitary flexible valve from a position outside of said webs to a position between said top and bottom webs at a valve insertion position in which the webs are respectively passing through said roller assemblies and converging upon one another, said flexible valve being positioned substantially perpendicular to the direction of travel of said top and bottom webs;

clamping said upper roller assembly and said lower roller assembly together to bring said upper and lower webs together and frictionally retain said valve between said webs;

conveying said clamped webs and valve to a die station without any permanent attachment of said valve to either of said webs; and then, at said die station, heat sealing a perimeter of an inflatable body shape onto said webs and retained valve such that said valve is simultaneously heat sealed to both of said webs.

2. The method of claim 1 further comprising the steps of selecting and forming said flexible valve and said webs of materials which are prone to adhere to each other due to their respective surface adhesion properties.

3. The invention of claim 1 comprising the further step of sensing when said flexible valve is at said valve insertion portion and then sending a signal to clamping means to perform said clamping step.

4. The invention of claim 1 comprising the further step of inserting said valve between said top and bottom webs such that at least a substantially portion of said valve extends externally from between said webs.

5. The invention of claim 1 comprising, prior to said heat sealing of said perimeter of said inflatable body shape, the further step of simultaneously heat sealing both said upper and lower webs to said valve at said die station.

6. The invention of claim 1 in which said clamping means comprises a pneumatic cylinder and piston.

7. The invention of claim 1 comprising the further steps of providing a draw roller at the beginning of said die station, drawing said webs with said valve clamped therebetween through said draw roller, and forming a preliminary, simultaneous heat seal between said valve and both of said webs after said webs and clamped valve pass through said draw roller,

8. The invention of claim 1 in which said valve comprises a self-sealing valve that has a sufficient length to extend into an inflatable body such that when inflatable body is fully inflated, said sufficient length will fold over and seal said passageway.

* * * * *

UNITED STATES PATENT AND TRADEMARK OFFICE

CERTIFICATE OF CORRECTION

PATENT NO. : 5,405,479

DATED : April 11, 1995

INVENTOR(S) : Brent G. Anderson

It is certified that error appears in the above-indentified patent and that said Letters Patent is hereby corrected as shown below:

In Claim 4, Column 8, Line 31 "substantially" should be —substantial—.

Signed and Sealed this

Eighth Day of October, 1996

Bruce Lehman

*Attest:*

BRUCE LEHMAN

*Attesting Officer*

*Commissioner of Patents and Trademarks*